US005301890A

United States Patent [19]

Schnell

[11] Patent Number: 5,301,890

[45] Date of Patent: Apr. 12, 1994

[54] DEVICE FOR ATTACHING A FLEXIBLE WEB TO A NEW EMPTY WEB-ROLL

[76] Inventor: Heinrich Schnell, Klingenweg 33/1, D-6930 Eberbach, Fed. Rep. of Germany

[21] Appl. No.: 466,354

[22] PCT Filed: Jul. 4, 1989

[86] PCT No.: PCT/EP89/00763

§ 371 Date: Jan. 8, 1991

§ 102(e) Date: Jan. 8, 1991

[87] PCT Pub. No.: WO90/00513

PCT Pub. Date: Jan. 25, 1990

[30] Foreign Application Priority Data

Jul. 9, 1988 [DE] Fed. Rep. of Germany ..... 3823311
Jan. 18, 1989 [DE] Fed. Rep. of Germany ..... 3901305

[51] Int. Cl.[5] ..... B65H 19/28

[52] U.S. Cl. ..... 242/56 R; 242/66

[58] Field of Search ..... 242/56 R, 56 A, 66, 242/65

[56] References Cited

U.S. PATENT DOCUMENTS

| | | | |
|---|---|---|---|
| 2,361,264 | 10/1944 | Christman | 242/56 A |
| 3,049,311 | 8/1962 | Birch, Jr. | 242/66 |
| 3,162,393 | 12/1964 | DeGelleke | 242/66 |
| 3,345,010 | 10/1967 | Egan | 242/66 |
| 3,727,854 | 4/1973 | Gotzbach | 242/66 |
| 3,794,256 | 2/1974 | Schwarz | 242/56 A |
| 3,817,467 | 6/1974 | Danbroth | 242/56 R |
| 4,000,863 | 1/1977 | Strayups | 242/56 R |
| 4,345,722 | 8/1982 | Kuhn | 242/56 R |
| 4,512,528 | 4/1985 | Kuhn | 242/66 X |
| 4,798,351 | 1/1989 | Malter et al. | 242/56 R X |
| 5,150,848 | 9/1992 | Consani | 242/56 R |

FOREIGN PATENT DOCUMENTS

| | | | |
|---|---|---|---|
| 2425454 | 12/1975 | Fed. Rep. of Germany | 242/66 |
| 2936382 | 4/1980 | Fed. Rep. of Germany . | |
| 2918821 | 11/1980 | Fed. Rep. of Germany | 242/56 R |
| 59-186855 | 10/1984 | Japan | 242/56 R |
| WO86/01186 | 2/1986 | PCT Int'l Appl. . | |
| 567999 | 10/1975 | Switzerland | 242/56 R |

*Primary Examiner*—Daniel P. Stodola
*Assistant Examiner*—John P. Darling
*Attorney, Agent, or Firm*—Darby & Darby

[57] ABSTRACT

An apparatus for winding lengths of flexible material into rolls has a drawing roller, and a shiftable friction roller which frictionally winds the material onto a growing roll. The rolls are wound on cores and the apparatus further comprises an application unit for initiating the winding of a fresh core. The application unit has a winding roller, and a plate which flanks and is spaced from the winding roller and extends along a portion of the circumference thereof. To initiate winding of a fresh core, the friction roller and the growing roll are moved away from the drawing roller to form a gap which is spanned by a taut section of the material. The application unit is in a retracted position. The fresh core is held against the taut section adjacent to the drawing roller which then rotates the core. The taut section is subsequently severed and the leading end of the resulting upstream segment of the material falls onto the plate of the application unit. The latter is now rotated from the retracted position to an advanced position in the direction of rotation of the core. In the advanced position, the upstream segment is wrapped around a major part of the core and the edge of the plate which faces the drawing roller is spaced from both the core and the drawing roller by a distance equal to at least 0.3 times the diameter of the winding roller. The winding roller now causes a fold to develop in the leading end of the upstream segment. The fold enters the nip defined by the core and the drawing roller to initiate winding of the fresh core.

40 Claims, 10 Drawing Sheets

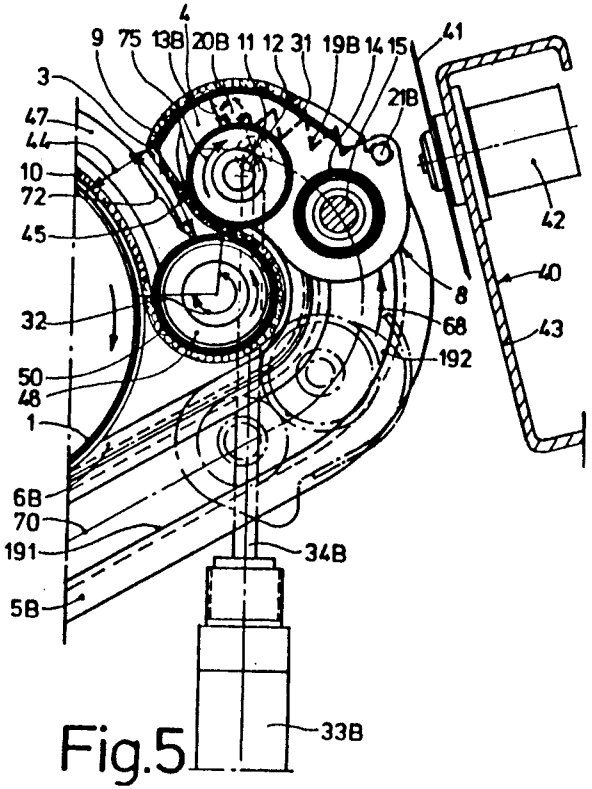
Fig.5
Fig. 4
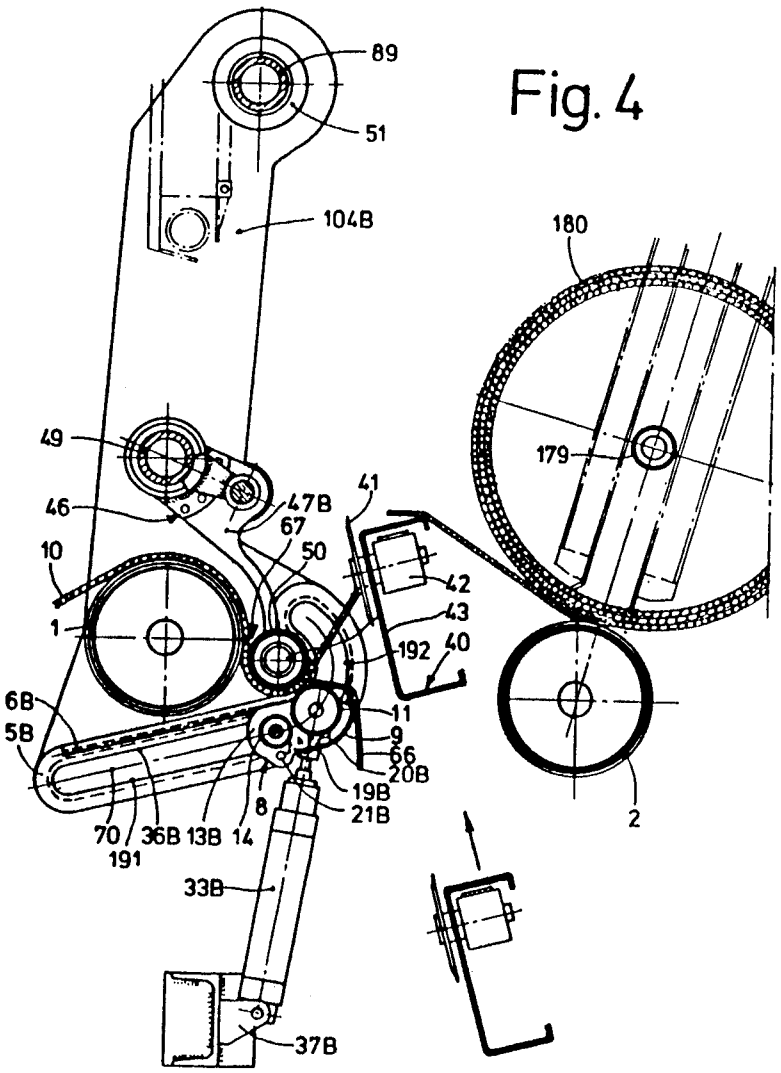

DEVICE FOR ATTACHING A FLEXIBLE WEB TO A NEW EMPTY WEB-ROLL

BACKGROUND OF THE INVENTION

The invention relates to a device for initiating the winding of a new, empty winding core, which replaces a fully wound bolt, with a continuous length of flexible material fed in by a draw-in roller that, in the winding-on position, is at axial distance to the fully wound bolt. The device has: a core feed, by means of which a new empty core is brought into a winding-on position in peripheral and driving contact with the draw-in roller, in which it is partially wrapped round by the section of the length of material that is fed tautly between the draw-in roller and the fully wound bolt; an application guide, on which a freely turning winding-on roller is mounted axially parallel to the draw-in roller and which, in its advance direction, on the side of the length of material that is fed tautly over a gap and is turned away from the empty core, is moved in the direction of rotation of the empty core taking with it the length of material, whereby the angle of wrap of the length of material round the new core is increased to more than 180 degrees; a cutting mechanism, by means of which the length of material that is tautly fed over the space between the winding-on roller and the fully wound bolt is cut, and means by which the new section of the length of material, under continuation of wrapping of the empty core and preceded by a fold as start of the first layer of the new bolt, is fed from the top into the gap that opens upwards between the winding-on roller and the full core and which, due to the rotation of the draw-in roller that is set for drawing-in, is drawn into the gap.

With such devices, it is important that the new start of the length of material is applied to the new core onto which it is to be wound without having to interrupt the continuous feed of the length of material. The lengths of material in question can be woven or knitted materials and fabrics and the like, as well as latticed webs of synthetic materials and foam rubber.

In the case of a device of this kind disclosed in U.S. Pat. No. 4,000,863, there is a turning arrangement, whereby the start of the new length of material is folded round its front edge. The turning arrangement is then driven into and wedged in the gap between the draw-in roller and the empty core to be wound. Hereby the start of the length of material, which is preceded by the fold caused by the turned over edge, is driven into the gap by the turning arrangement until being engaged between the draw-in roller and the new core. Once this has happened, the turning arrangement is then withdrawn from the fold of the length of material and, thus, also out of the gap.

In the case of the disclosed device, the turning arrangement necessarily requires the guiding of the start of the new length of material until it is jammed in between the draw-in roller and the empty core and engages.

SUMMARY OF THE INVENTION

An object of the present invention is to design a device of the type originally described in a more simple way, in particular in such a way that it can be easily adapted to accommodate the various qualities of the materials to be handled with regard to flexibility, thickness and so forth.

The distinguishing features of the present invention are that there is a guide plate mounted on the application guide that extends across the complete width of the winding-on roller at radial distance to the circumference of the winding-on roller and over a section of the circumference of the winding-on roller. At the front end in the advance direction, the guide plate features a front edge that extends axially parallel to the draw-in roller, and the guide plate also features a guide surface on the outside for the new section of the length of material, on which it can be spread out flat and slide. In the end position of the advance movement of the application guide, the empty core is wrapped round by at least 240 degrees and the front edge of the guide plate is at radial distance to the circumference of the empty core and at radial distance to the circumference of the draw-in roller, which, in each case, amounts to 0.3 to 2 times or preferably 0.7 to 1.3 times the diameter of the winding-on roller.

The invention takes advantage of the fact that, in order to be able to guide the length of material reliably and precisely into the gap between the draw-in roller and the new core, it is not necessary, as with the known device, to have to guide the material on the last part of the draw-in movement. According to the invention, the start of the new length of material, that is held in readiness on the guide plate, slides over the guide plate and, in doing so, comes into contact with the sections of the length of material that lie over the circumferential sections of the draw-in roller and core that bound the gap. The start of the new length of material that initially spans the gap is drawn into the gap by the rotary movement of the draw-in roller and the core, whereby it forms a fold. The turning arrangement that, in the case of the known device initially described, drove the start of the length of material into the gap, is no longer necessary. Thus, the very complicated, rapidly operated drive parts for this turning arrangement are also unnecessary. A guide plate, that, by comparison, is simple in design and must be operated slowly, is all that is needed.

Under the influence of its weight, as well as of the decreasing tension, the new section of the length of material slides into the gap as soon as it has been cut. This sliding movement can be adjusted to suit the flexibility and the weight, as well as the other qualities of the material being processed, by means of the appropriate design and arrangement of the guide plate in its winding-on position. It is important that the length of material can be inserted in the desired way by having sufficient space at the front edge of the guide plate. In contrast, to adjust the initially described known device accordingly, it is necessary to convert or retrofit the turning arrangement and its drives.

In order to favourably influence the aspired sliding movement, it is advisable that, in the winding-on position that it assumes in the end position of the advance movement of the application guide, in relation to its guide surface, the guide plate is directed diagonally downwards into the gap that opens upwards between the draw-in roller and the new core.

BRIEF DESCRIPTION OF THE DRAWINGS

The invention will now be described in detail with the aid of the appended drawings.

In the drawings:

FIGS. 2 to 8 show the parts from FIG. 1 in various, successive operating positions during the changeover of bolts

DESCRIPTION OF THE PREFERRED EMBODIMENTS

In the following description of the figures some reference numbers are followed by an "A" or "B". This suffix indicates the left or right side respectively of the device. The parts in question correspond mirror-symmetrically to each other.

The continuously fed length of flexible material, which can consist of various materials, e.g. knitted or woven fabrics, is marked with 10 in FIGS. 1–8.

The draw-in roller 1 and the friction roller 2 are mounted axially parallel to each other, have the same diameter and are driven at different circumferential speeds in the same direction of rotation by the gears with the variable speed motors mounted on them.

Figure 1:
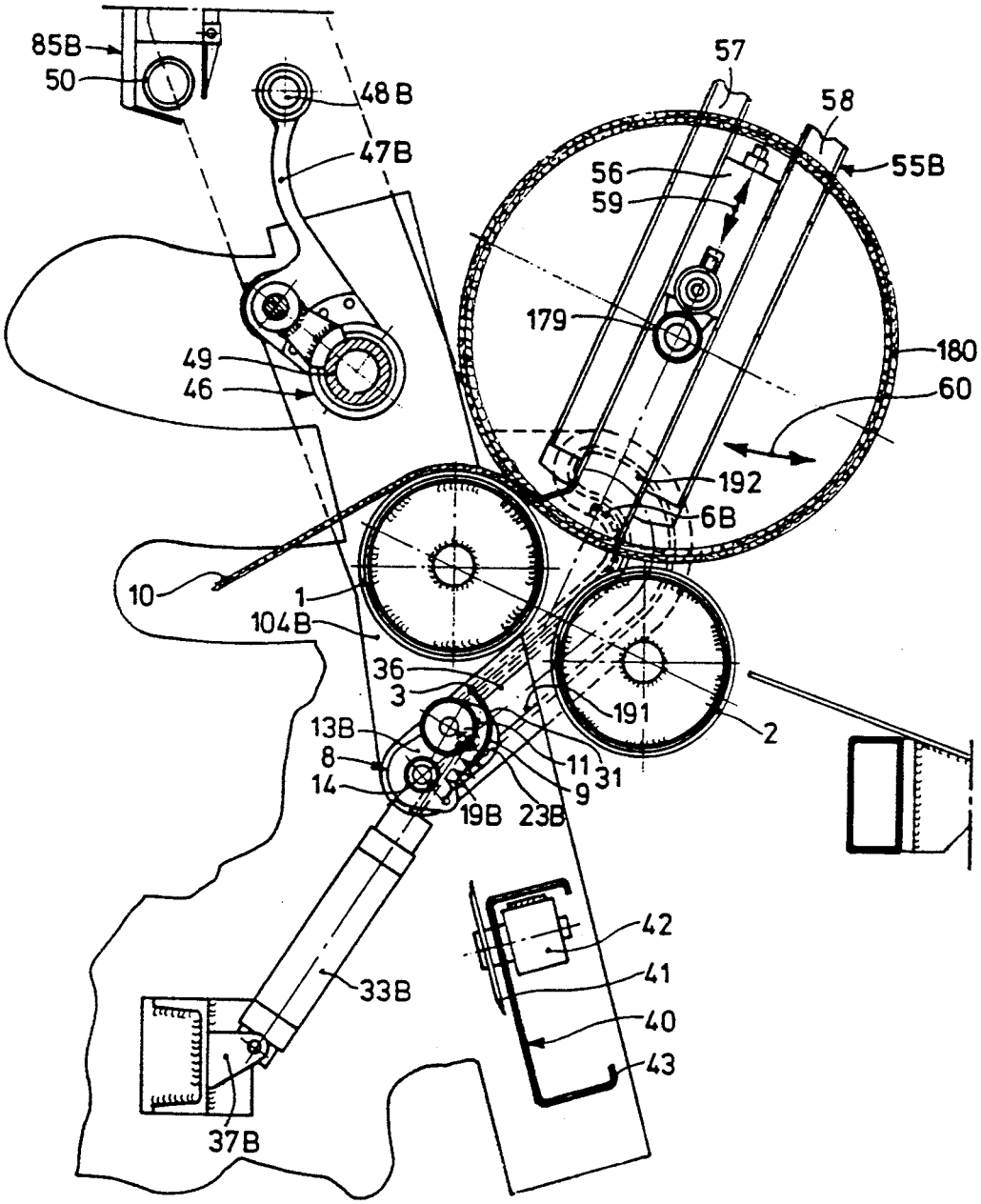
FIG. 1 shows various functional parts of a first embodiment of a winding device

The draw-in roller 1 is on the support arms 104 A, B that are pivot-mounted on the through shaft 89. The end positions of the support arms are illustrated in FIG. 1 with a full bolt 18 and in FIG. 8 with a new bolt 187.

Above the draw-in roller 1 there is core magazine attachment 85 A, B that is mounted in such a way that it cannot turn but that it is axially adjustable with the aid of a journal bearing on the pivot-mounted hollow shaft 89.

Figure 2:
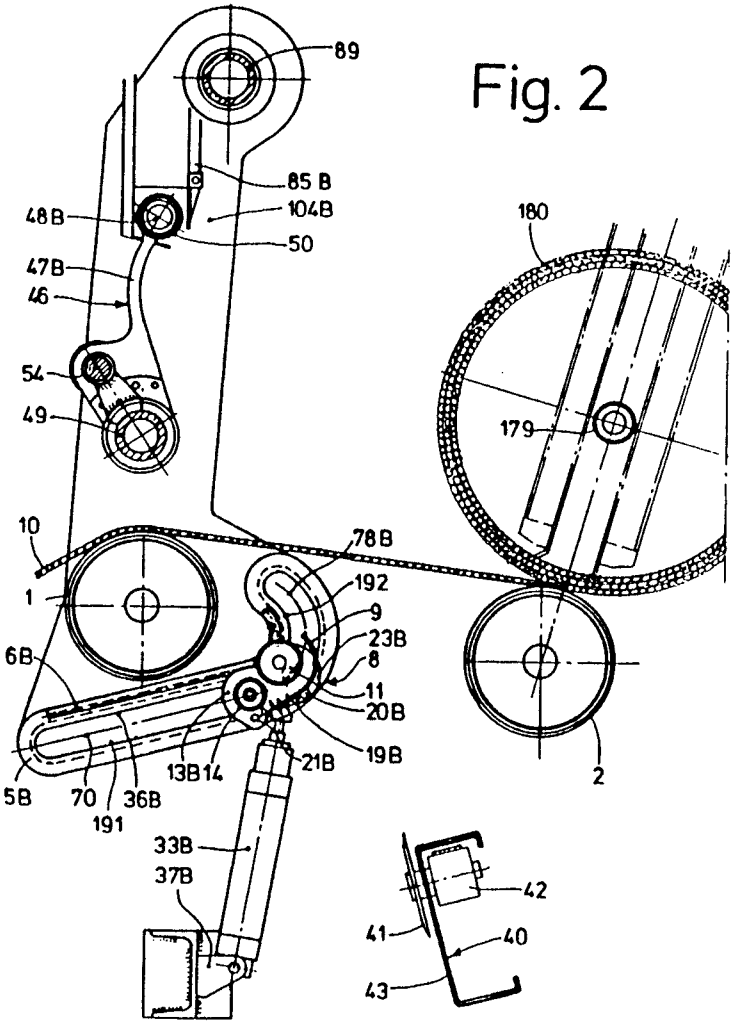

In the position shown in FIG. 2, there is a space between the friction roller 2 and the draw-in roller 1 that is spanned by a fed-in length of flexible material 10.

Figure 3:
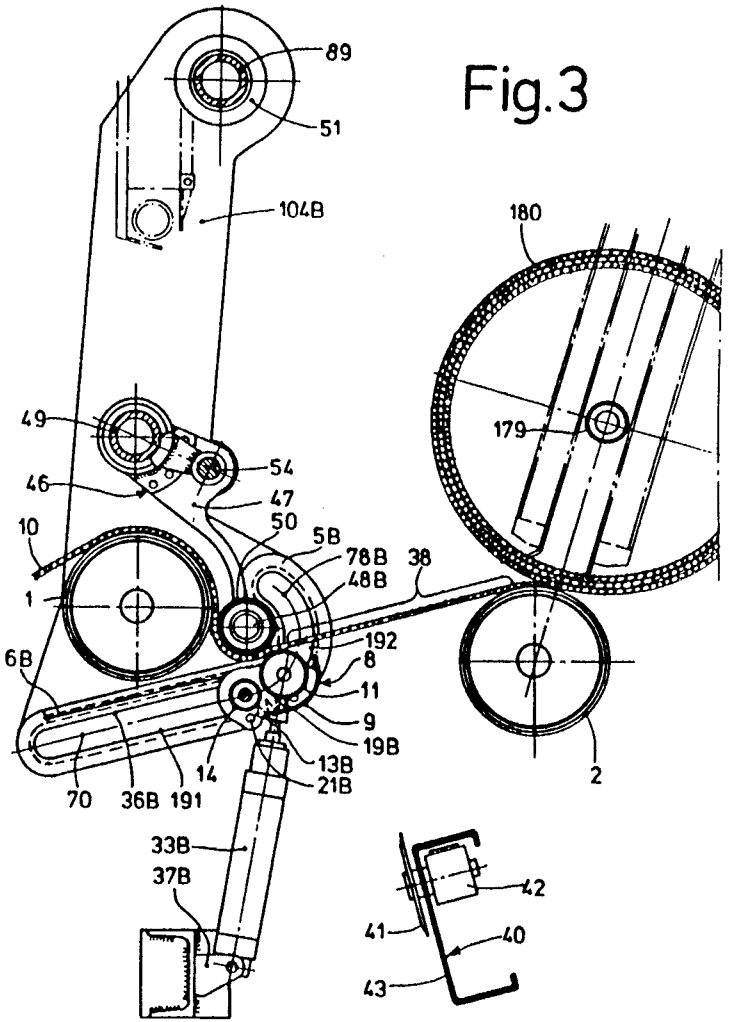

FIG. 3 shows the operating position following FIG. 2, in which the parts illustrated are advanced in order to prepare for the cutting of a section 38 of the material 10 referred to as the functional section.

There is a transverse cutting mechanism 40 located under this section. On the transverse cutting mechanism 40 there is a row of polygonal blades 41 connected to a driving roller 42 that is mounted in a cutter beam 43. The polygonal blades are driven by a motor via a drive belt. The polygonal blades rotate in opposite directions. The transverse cutting mechanism is shown in FIG. 1 in a lowered, ineffective idle position.

In FIG. 4 the transverse cutting mechanism is shown in its raised cutting position, in which it cuts through the functional section 38 of the tautly fed length of material 10 with the cutting edges of its polygonal blades.

Figure 10:
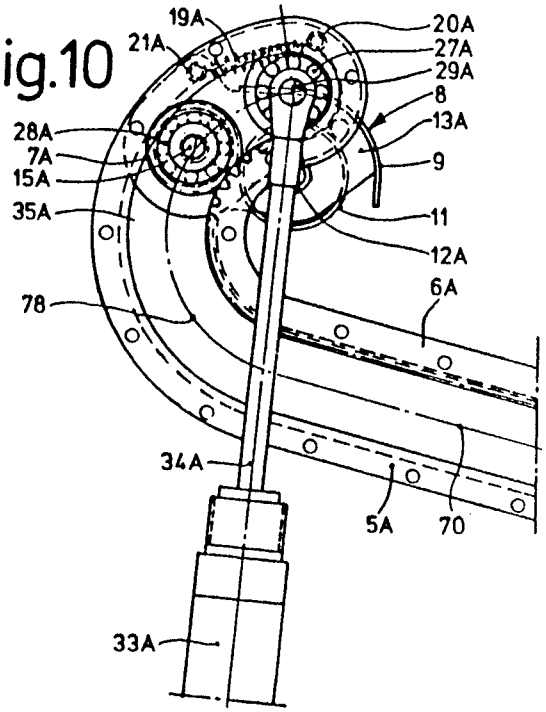
FIG. 10 is a sectional view as seen in the direction of the arrows X—X of FIG. 9
Figure 9:
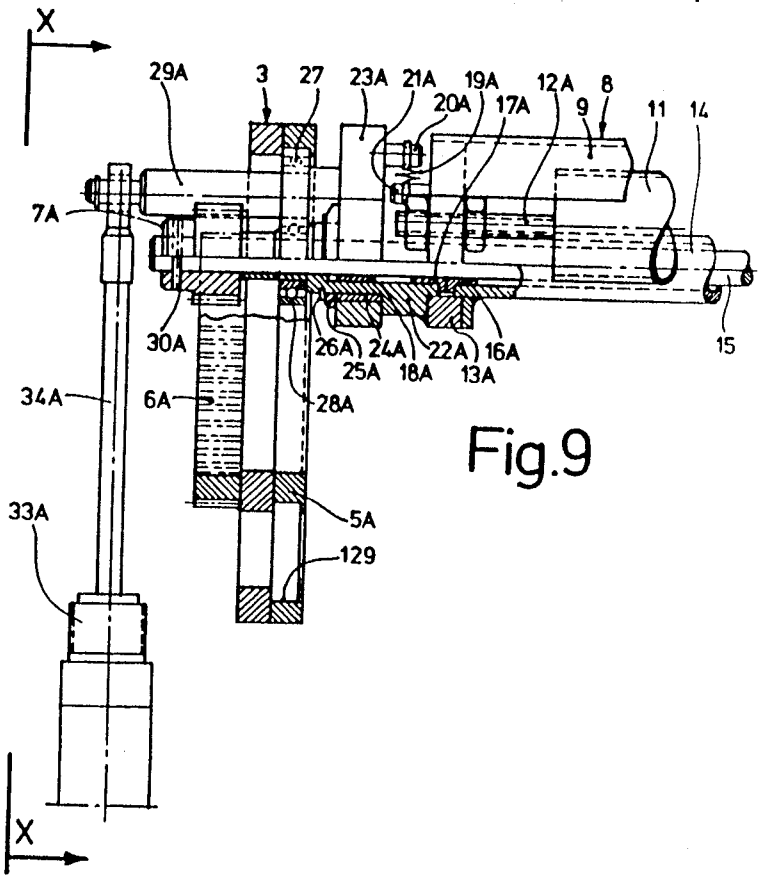
FIG. 9 is a sectional view as seen in the direction of the arrows IX—IX of FIG. 7

On the free, pivoting end of the support arm 104 A, B there is a curved guide 36 A, B that is designed in such a way that the circular path 35 A, B from the middle of the core feed runs in the radius 78 through a range of about 120 degrees. The cover plate 5 A, B according to FIGS. 9 and 10 is designed in such a way that there is a bearing guide way 129 A, B which accommodates the bearings 27 A, B and 28 A, B and, together with the support arm 104 A, B, forms a groove. On the other side of the support arm there is a permanently fixed toothed segment 6 A, B of about 120 degrees, also in the radius 78. Furthermore, there is a cylinder 33 A, B pivot mounted on the cylinder holder 37 A, B, which is fitted to the machine framework. For actuating the application guide the piston rod 34 A, B, which has a pivot bearing, can be fitted onto the bolt 29 A, B and can move it.

The application guide 8 is integrated on the support arm 104 A, B and is automatically moved by means of cylinders 33 A, B in the curved guide 36 A, B in the radius 78 through about 120 degrees parallel to the hollow shaft. For moving the application guide there is a guide piece 23 A, B having a fixed bolt 29 A, B with a ball bearing 27 A, B that automatically runs in the bearing guide way. So that the guide piece 23 A, B is guided parallel in the guide way 129 A, B, the guide piece 23 A, B is fitted onto the spacer shaft 15 that is mounted in the bearing 24 A, B, secured by an eccentric spring ring 25 A, B and followed by a firmly seated ball bearing 28 A, B. On the shaft 15 there is a pivot-mounted rocker arm 13 A that connects to a spacer tube 14, and the tube 14 is also connected with the rocker arm 13 B on the other side in such a way that it cannot turn. In the spacer tube 14 there is the spacer shaft 15, that is mounted in the bearings 16 A, B, 24 A, B and 28 A, B and features a gear wheel 7 A, B secured by a cotter pin 30 A, B on the shaft end. The gear wheel 7 A, B mates with the toothed segment 6 A, B and synchronizes the rotation of the application guide 8 over the spacer shaft 15. The rocker arm 13 A, B connected with the shaft 15 is mounted so that it can turn on its axis and is drawn in the direction of the draw-in roller 1 by means of a tension spring 19 A, B that is connected to a spring bolt 20 A, B fixed on the guide piece 23 A, B and to a spring bolt 21 A, B connected to the rocker arm 13 A, B. On the rocker arm 13 A, B there is a guide plate 9 mounted in such a way that it cannot turn and the winding-on roller 11 is located under this. The winding-on roller 11 is mounted for rotation and is held by the bolts 12 A, B.

The application guide 8 is illustrated in FIGS. 1 to 10.

The application guide 8 is moved up and down in the curved guide 36 A, B with the aid of the cylinders 33 A, B and by the to and fro movement of the support arm 104 A, B in the pivot point on the hollow shaft 89.

As can be seen in FIG. 1, there is a pivot-mounted core feed 46 A, B on the support arm 104 A, B. A rotatable hollow shaft 49, is coaxial with and associated to the core feed 46 A, B. The transport arm 47 A, B is mounted so that it cannot turn but is axially adjustable on the hollow shaft 49. The up and down pivoting motion of the core feed 46 is carried out with the aid of a cylinder. The core feed 46 A, B is shown in one end position of the pivoting motion in FIG. 1 and in the other end position of the pivoting motion in FIG. 2. A core pick-up 48 A, B is located on the free end of the transport arm 47 A, B.

Once the core 50 is positioned between the draw-in roller 1 and the friction roller 2, the core is released by retracting the cylinders.

A core guide 55 is located above the friction roller 2. The core guide consists of straight guide rails pivot mounted at their top ends in a flange bearing. The flange bearing is fixed in position on the machine framework. The pivoting motion of the guide rails is achieved by a double cylinder. FIG. 1 shows the core guide 55 in the winding position.

The described shafts, and the axles of the pivot bearings, unless expressly stated otherwise in the text, extend parallel to each other, i.e. parallel to the axes of the draw-in roller 1 and the friction roller 2 or perpendicular to the drawing planes of FIGS. 1 to 8.

The mode of operation of the device will now be explained with particular reference to the FIGS. 1 to 8.

According to FIG. 1 the bolt 180 is almost completely wound. The core 179 of this bolt is guided in the core guide 55, the guide plate of which, following the increasing diameter of the bolt 180 has slid upwards in the guide rails. At the bottom the bolt rests on the draw-in roller 1 and the friction roller 2 and is turned round by these, whereby it pulls the flexible length of material 10 with it. The support arm 104 is in the operating position of FIG. 1 which it assumes during winding.

The tightness of the bolt 180 can be regulated with the aid of the friction roller 2. In the operating position shown in FIG. 1, the application guide 8, the transverse cutting mechanism 40 and the core feed 46 are in an ineffective, idle position.

As soon as the bolt 180 has reached the required size, a control command is given initiating the procedures described below. Firstly the support arm 104 A, B with the draw-in roller 1 swivels into the winding-on position shown in FIG. 2. At the same time the application guide 8, automatically supported against the cylinder 33 A, B, is pushed forward into its position of readiness at the end of the straight section 70 of the curved guide 36 A, B and, thus, to the start of the circular path 35 A, B. The core feed takes up a new core 50 and pushes this into functional section 38 against the draw-in roller 1. Thus, the core, with an intermediate layer of the length of material 10, comes into peripheral contact with the draw-in roller 1.

The application guide 8 is now in its position of readiness shown in FIG. 3. The application guide 8 now presses with the winding-on roller 11, with an intermediate layer of the flexible length of material 10, under the influence of the tension spring 19 against the lower circumference half of the core 50. The application guide 8 is now in a position of readiness, while the flexible length of material 10 continues to be fed in the direction of the friction roller 2 without touching the guide plate 9. When the signal "cut" is given, the transverse cutting mechanism 40 is brought into the cutting position and cuts the functional section 38 of the flexible length of material 10 as shown in FIG. 4. At the same time the application guide 8 is moved in the direction of movement 68 on the circular path 35 with the aid of the cylinder 33 A, B. After cutting, the new section 66, i.e. the start of the new length of material, falls onto the guide plate 9, that is located on the application guide 8, and remains lying on it. The guide plate 9 extends across the complete width of the winding-on roller at radial distance 4 to the circumference of the winding-on roller and over a section of the circumference of the roller.

The piston rod 34 now carries out a stroke, whereby the application guide is moved forward along the circular path 35 A, B into its winding-on position at the end of this circular path. The winding-on roller 11 rolls, hereby, over the core 50 with the intermediate length of textile material 10, pressed on by means of the tension spring 19, onto the top half of the core. The guide plate 9 with the section 66 of the length of material 10 lying on top is, at the same time, moved into the top area with the aid of the application guide 8 as shown in FIG. 5. When the application guide 8 is in this upper position during the winding round of the core 50, there is a brief standstill of the material feed.

At the front end in its advance direction the guide plate 9 features a front edge 3 that extends axially parallel to the draw-in roller. The guide plate features an external guide surface 31 on which the new section 66 of the length of material can be spread out flat and slide. In this application position the empty core 50 is wound round by the length of material with an angle of wrap 32 of at least 240 degrees and the front edge 3 of the guide plate extends at radial distance 45 to the circumference of the empty core and at radial distance 44 to the circumference of the draw-in roller. Both distances 44 and 45 amount to 0.3 to 2 times or preferably 0.7 to 1.3 times the diameter of the winding-on roller 11. Related to the guide surface 31, in its winding-on position the guide plate 9 is directed diagonally downwards into the gap 67 that opens upwards between the draw-in roller and the new core. The angle of the guide plate, the slipperiness of its guide surface and the distances 44 and 45 can be varied to suit the different qualities of the lengths of material being processed. They can be adapted by changing over the guide plate or altering the installation.

The winding-on roller 11, that has now reached the highest point of the core 50, as shown in FIG. 5, transports the section of material 72 of the flexible length of material further in direction 76 on the core surface downwards in the direction of the gap 67.

Figure 7:
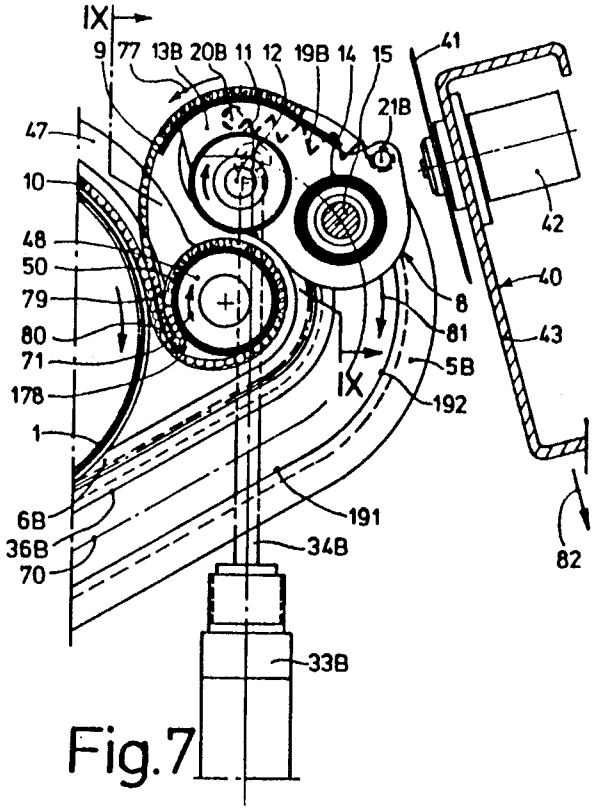
Figure 6:
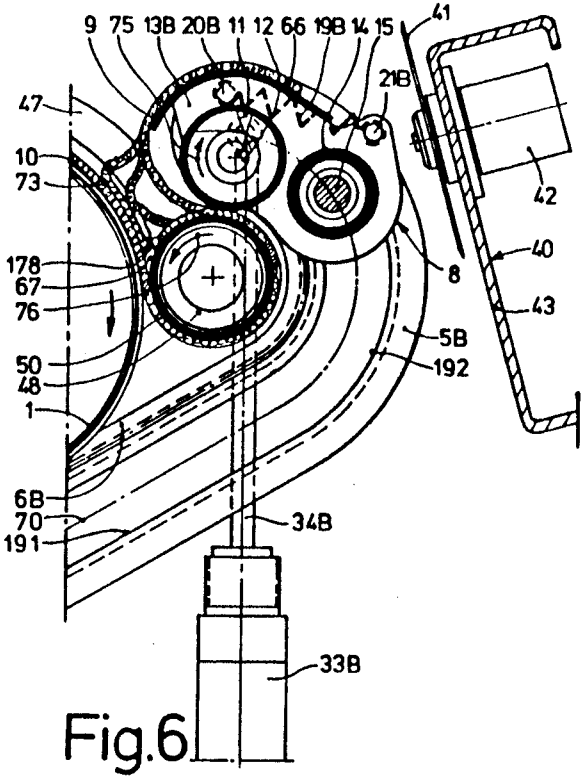

The section 72 now comes into contact with the length of flexible material 10 carried on the draw-in roller 1 and, for a brief time, it forms a layer 73 as shown in FIG. 6. As a result of the surface friction between the layer 73 and the length of flexible material 10 a fold 178 is formed in this operating position, which is drawn in between the length of material 10 at the circumference of the draw-in roller 1 and the core 50, so that the new initial section 66 resulting from the cutting process, is incorporated in direction 77 into the gap 67 as a fold, as shown in FIG. 7. The new section 66 is now wound in with the flexible length of material 10 and held on the core 50 by jamming.

Figure 8:
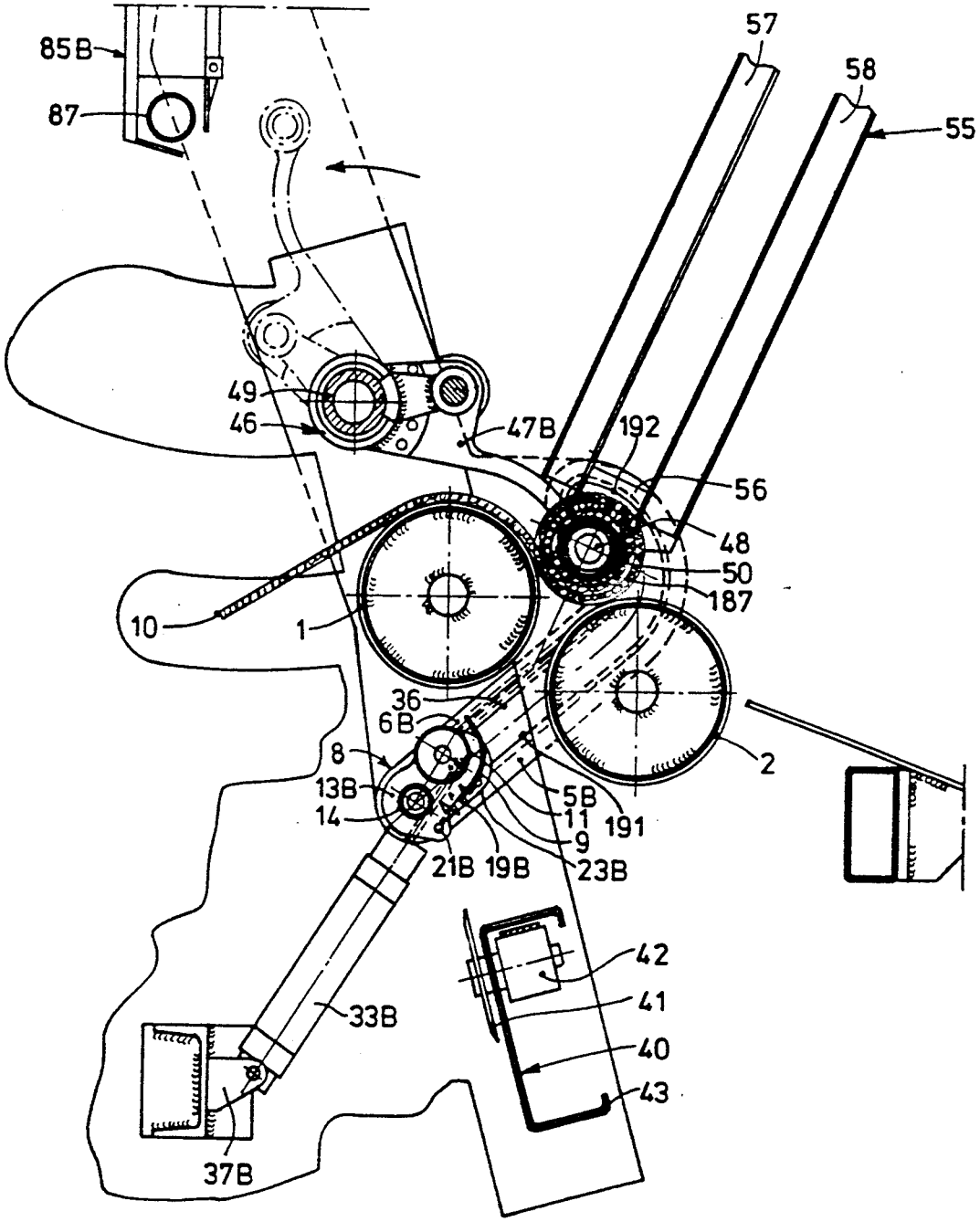

Having remained in the operating position for a short interval, the transverse cutting mechanism 40 and the application guide 8 now retract in directions of movement 81 and 82 into their ineffective idle positions, as shown in FIG. 8. At the same time the core guide, which can swing as indicated by the double-headed arrow 60 of FIG. 1, is swung outwards so that the full bolt 180 can drop off. The new bolt 187 continues to be wound onto the core 50 by application on the draw-in roller 1. By operating a cylinder, the support arm 104 A, B with the draw-in roller 1 and the core feed 46 is brought into the transfer and winding position, as shown in FIG. 8. After the new bale 187 has reached the friction roller 2, the mandrels of the core pick-up 48 A, B are retracted and the core feed 46 returns to the initial position shown in FIG. 1.

With the further embodiments now to be described with the aid of FIGS. 11 to 17, only those variations of these embodiments that are important for the invention will be described in comparison to the first embodiment illustrated in FIGS. 1 to 10. Unless otherwise described and specially illustrated, the embodiments to be described below are designed exactly as the first embodiment.

The curved guide 311 is associated to a guide curve 300, which follows the circular path 309 in the radius 307 at the guide distance and is fitted to the cover plate 312.

On the hollow shaft 313 there is a fixed rocker arm 303, and a spacer tube is connected with the rocker arm 303 so that it cannot turn. On the rear section of the rocker arm 303 there is a pressure roller 304 which is connected by means of a bolt 305, lies on the closing cam 302 of the guide curve 300 and holds the winding-on roller 315 ineffective in this position. A tension spring 316 pulls on the rocker arm 303 as shown in FIG. 11.

Figure 12:
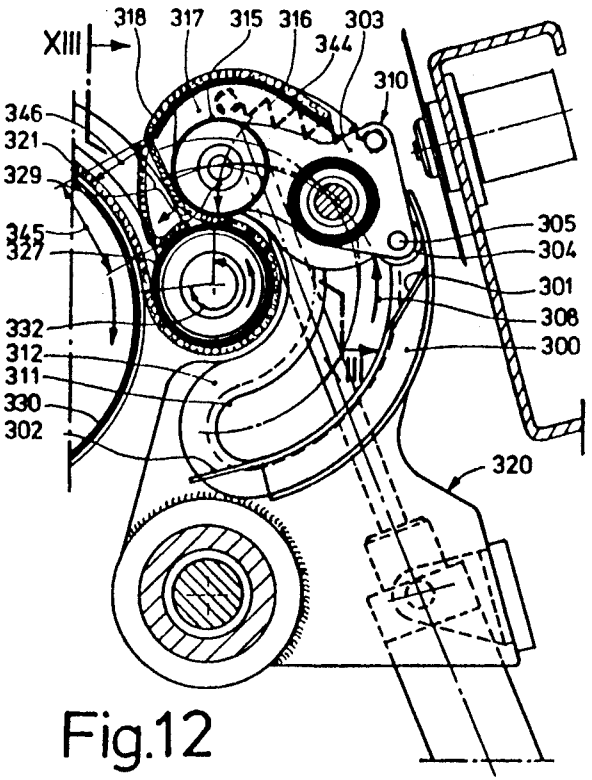
FIG. 12 shows the parts of FIG. 11 in the next operating position

According to FIG. 12 the winding-on roller 315 is in operation, whereby the pressure roller 304 is guided via the opening cam 301 outwards in direction 308 and the rocker arm 303 moves in direction of movement 306 under the action of spring 316. A guide plate 318 is mounted on the guide piece 317 so that it cannot turn.

Figure 11:
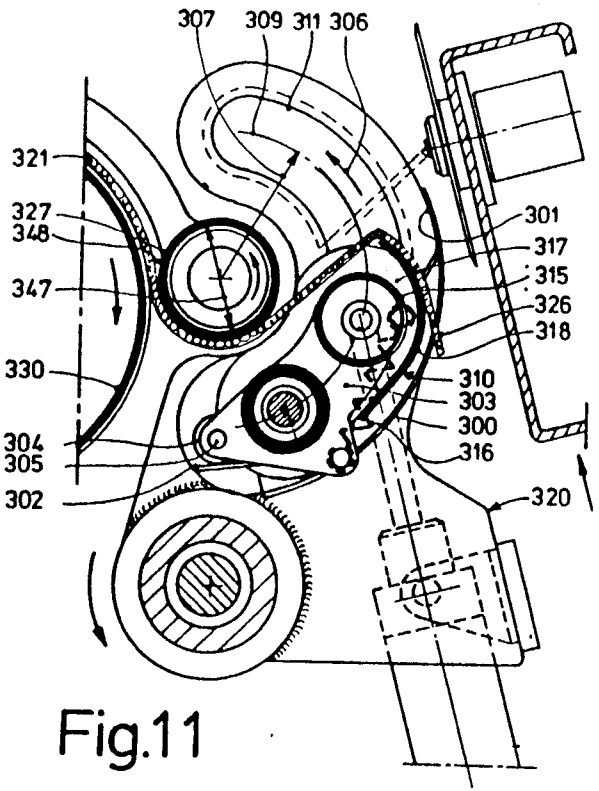
FIG. 11 is similar to FIG. 4 but shows parts of a second embodiment
Figure 13:
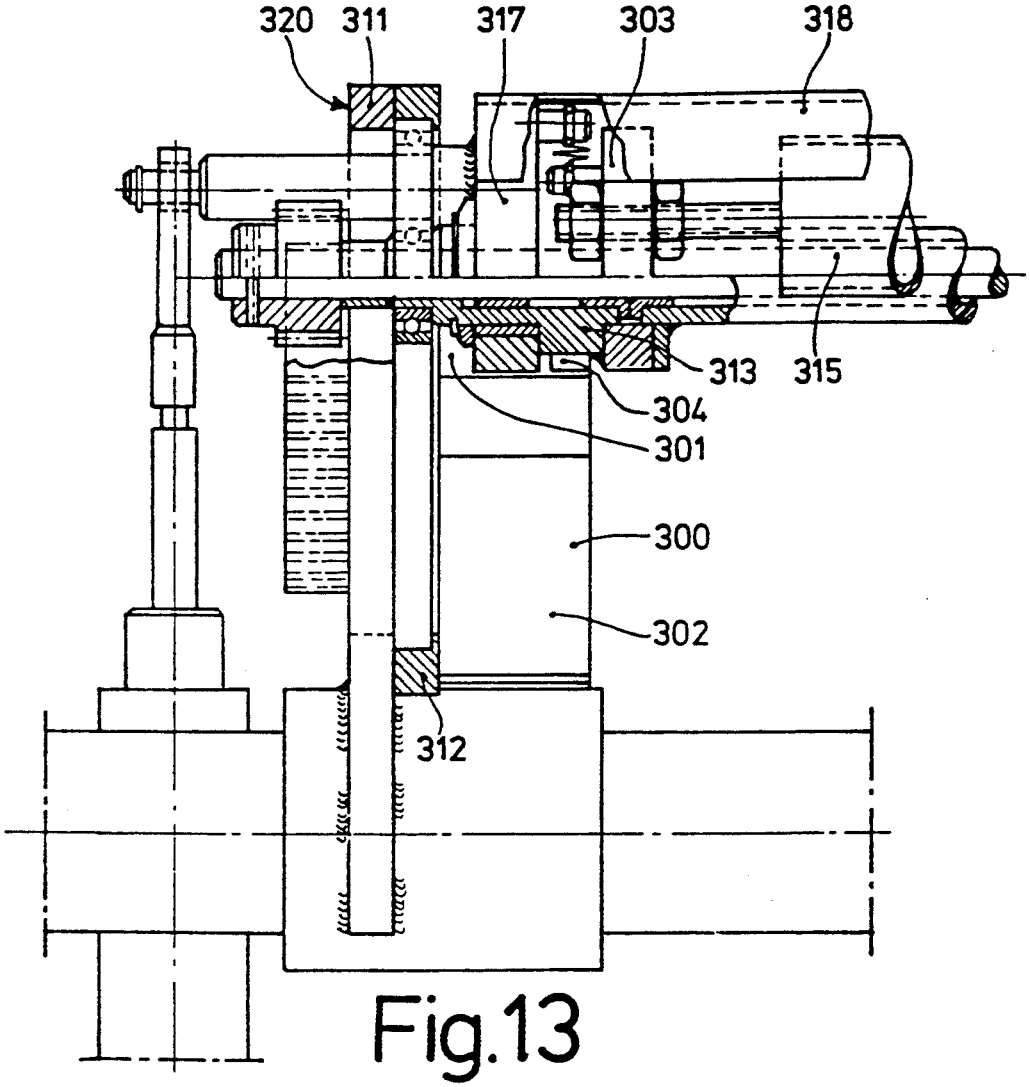
FIG. 13 is a partly sectional side view as seen in the direction of the arrows XIII—XIII of FIG. 12

Now the support arm 320 swings together with the application guide 310 into its winding round position shown in FIG. 11. The application guide, together with the winding-on roller, is free under the length of flexible material 321, pressed by the tension spring 316 against the closing cam 302 by means of the pressure roller 304. The application guide 310 is now in the waiting position while the length of flexible material continues to be fed, without touching the guide plate, in the direction of the friction roller. When the signal "cut" is given, the transverse cutting mechanism is moved into the cutting position and cuts through the functional section of the length of flexible material 321. At the same time the application guide 310 is moved with the aid of a cylinder in direction 306 on the circular path 309. After cutting the end 326 of the length of material falls onto the guide plate 318 and remains lying on it.

The guide plate 318 now lifts the flexible material 321 without touching the core 327 round the core until it reaches the highest point. Once the guide plate 318 has reached the highest point, after the rocker arm 303 has moved along the guide curve of the closing cam 302 to the opening cam 301 in direction 306, the winding-on roller 315 goes onto the top half of the core and presses the intermediate layer of textile material 321 by spring action along the radius 307 onto the top half of the core. This position is shown in FIG. 12.

The guide plate 318 with the section 329 of the length of material on it is, at the same time, brought into the upper area with the aid of the application guide 310 in the manner previously described with reference to FIG. 5. When the application guide 310 is in the upper position, during the pivoting round of the core 327, there is a short standstill of the material feed. The length of textile material in the section 329 is held taut until the pivot movement comes to a stop.

The winding-on roller 315, that has now been driven to the highest point of the core 327, now transports the length of material in the section 329, as previously described with reference to FIG. 5, further on the core surface downwards in the direction of the draw-in roller 330.

Figure 15:
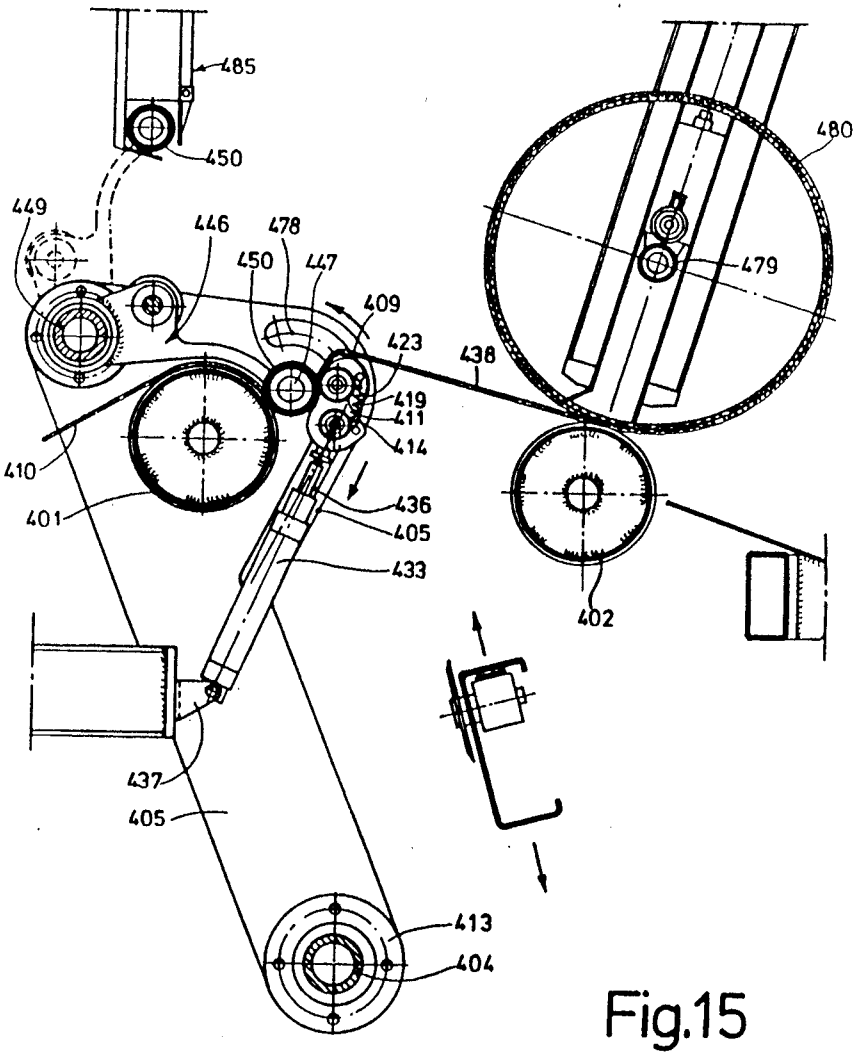
FIG. 15 shows the parts of FIG. 14 in a subsequent operating position
Figure 14:
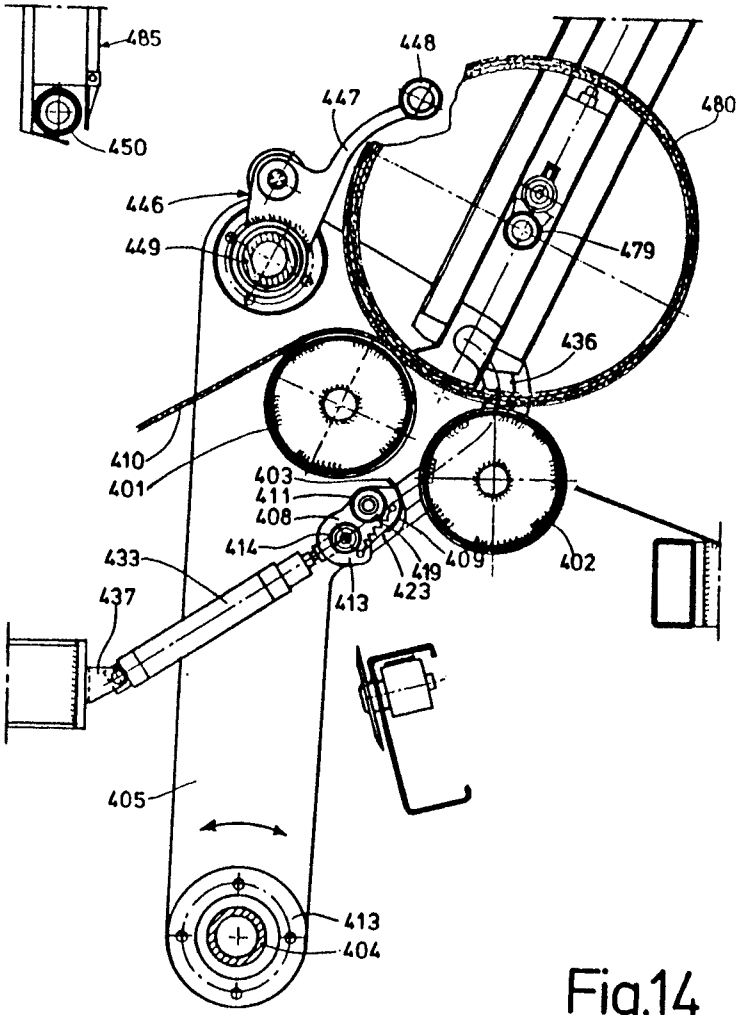
FIG. 14 is similar to FIG. 1 but shows parts of a third embodiment

Compared to the first embodiment shown in FIGS. 1 to 10, the main difference with the third embodiment shown in FIGS. 14 and 15 is that the pivot point of the support arm 405 is located underneath the draw-in roller 402 on a hollow shaft together with the connection flange 413. In FIGS. 14 and 15 the corresponding parts are marked with the same reference numbers as in FIGS. 1 to 10 but with 400 added. In the case of the fourth embodiment shown in FIGS. 16 and 17, there is a turning arrangement 503 mounted in such a way that it cannot turn on a rotatable hollow shaft 526. The turning arrangement 503 is mounted coaxially to the hollow shaft 526. The turning arrangement 503 features a lever arm 504 that is connected so that it cannot turn with the sleeve 505 and on which, hinged suspended on a cylinder 516, there is a plate holder 513 that is pivot mounted and held by a bolt 514 on the lever arm 504.

Figure 17:
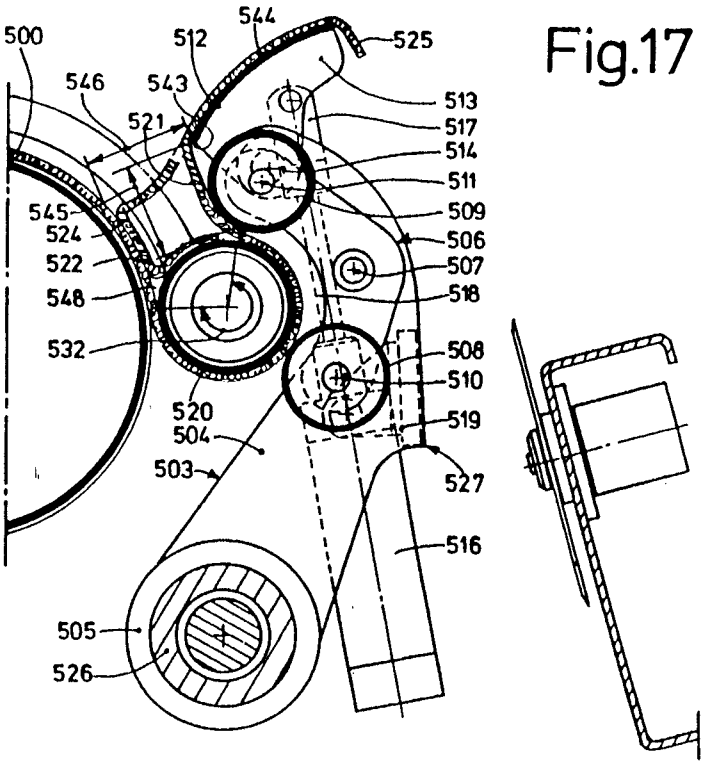
FIG. 17 shows the parts of FIG. 16 in a subsequent operating position.
Figure 16:
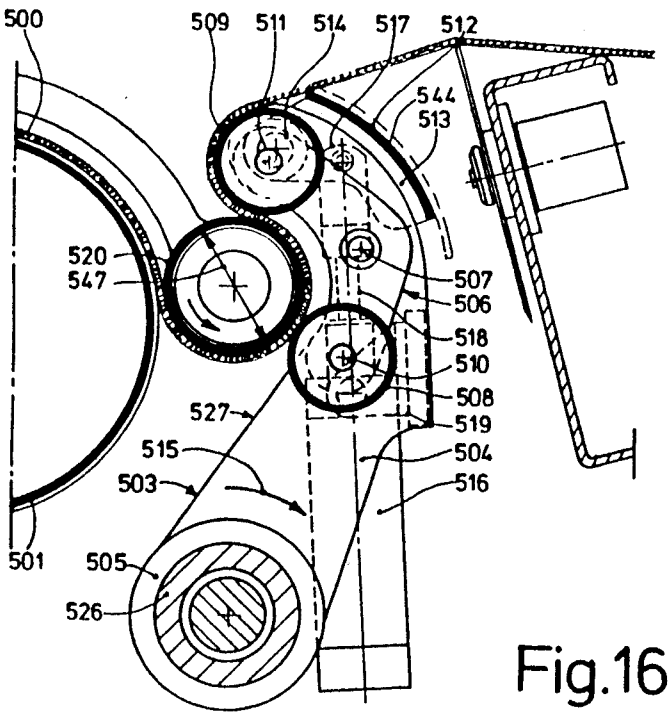
FIG. 16 is similar to FIG. 3 but shows parts of a fourth embodiment

The plate holder 513 with the guide plate 512 mounted on it extends across the complete width of the length of material. A rocker arm 506 with two guide rollers 508 and 509 that can be pivoted by the application guide 507 is mounted on the lever arm 504. The guide rollers 508 and 509 are fixed on the rocker arm in such a way that they can turn by means of the bolts 510 and 511. In FIG. 17, after the cutting through of the length of material, the plate holder 513 is moved by means of the cylinder 516 on the holder 519, that is mounted on the lever arm 504, via the piston rod 518 with the swivel arm 517 into the braking position.

As in FIGS. 1 to 10, the length of flexible material is fed over the draw-in roller 501 round the core 520. Both guide rollers 508 and 509 are applied to the circumference of the core 520 with the intermediate layer of the length of material 500. After the length of flexible material 500 has been cut, the plate holder 513 is moved diagonally upwards through an angle of about 90 degrees, thus effecting the braking function of the guide plate 512, so that the cut-off end 525 stays put. The section 521 of the length of material between the guide plate 512 and the guide roller 509 rolls further in the direction of the draw-in roller 501 over the core 520, at the same time forming a friction surface 524 in order, thus, to be drawn in between the length of flexible material and the core 520, whereby the section 525 of the length of material is wound in with it.

The plate holder 513 is now retracted and the turning arrangement 503 is swung back in the direction of movement 515 through about 90 degrees into its idle position. All other operating processes correspond to those explained with regard to FIGS. 1 to 10.

As in the case of the first embodiment, the guide plates of the other embodiments feature a front edge, e.g. 543 in FIG. 17, that extends axially parallel to the associated draw-in roller. On the outside the guide plate has a guide surface 344 (FIG. 12), 544 (FIGS. 16 and 17) for the new section of the length of material, on which the material can be spread out flat and slide.

In the end position of the advance movement of the application guide the empty core is wrapped round by at least 240 degrees. In this end position the front edge of the guide plate is at radial distance 345 (FIG. 12), 545 (FIG. 17) to the circumference of the empty core and at radial distance 346 (FIG. 12), 546 (FIG. 17) to the circumference of the draw-in roller, which in each case amounts to 0.3 to 2 times or preferably 0.7 to 1.3 times the diameter of the winding-on roller.

In this end position, that is also called the winding-on position, the guide plate 318, 409, 512 is directed diagonally downwards with reference to its guide surface into the gap 348 (FIG. 11), 548 (FIG. 17) between the draw-in roller and the new core.

I claim:

1. A winding apparatus, comprising means for conveying a length of material along a predetermined path; means for winding the material; means for dividing the material into upstream and downstream segments; means for supplying a core which is to be wound with the material to a winding position in which the core is positioned to initiate winding of the upstream segment of the material onto the core; and means for initiating winding of the upstream segment of the material onto a core in said winding position, said initiating means including an application unit provided with a wrapping element, and a plate receiving element extending around part of the circumference of said wrapping element, said application unit being movable between a retracted position and an advanced position in which said wrapping element cooperates with a core in said winding position to wrap the material around part of the periphery of the core, and said receiving element having a generally convex external surface which faces away from said wrapping element, said receiving element being arranged such that the upstream segment of the material is receivable on said surface.

2. The apparatus of claim 1, wherein said conveying means comprises a drawing roll which is disposed at a predetermined location in the region of said winding position when winding of a core is initiated, said receiving element having a leading edge as considered in the direction of movement of said application unit from said retracted position to said advanced position, and said leading edge extending transverse to said direction, said wrapping element having a predetermined diameter, and said leading edge being spaced from said drawing roll and from the periphery of a core in said winding position by a distance of at least 0.3 times said predetermined diameter when said application unit is in said advanced position and said drawing roll is at said predetermined location.

3. The apparatus of claim 2, wherein said distance is 0.3 to 2 times said predetermined diameter.

4. The apparatus of claim 3, wherein said distance is 0.7 to 1.3 times said predetermined diameter.

5. The apparatus of claim 1, wherein said application unit cooperates with a core in said winding position to wrap the material around a part of the core having an angular measure of at least 240 degrees.

6. The apparatus of claim 1, wherein said receiving element extends across substantially the entire length of said wrapping element.

7. The apparatus of claim 1, wherein said conveying means comprises a drawing roll which is disposed at a predetermined location in the region of said winding position when winding of a core is initiated.

8. The apparatus of claim 7, wherein said receiving element has a leading edge as considered in the direction of movement of said application unit from said retracted position to said advanced position, said drawing edge being substantially parallel to said axis.

9. The apparatus of claim 7, wherein said predetermined location is spaced from said winding means.

10. The apparatus of claim 7, wherein said drawing roll at said predetermined location is arranged to be in driving engagement with a core in said winding position.

11. The apparatus of claim 7, wherein the upstream segment of the material has a leading end and said drawing roll at said predetermined location is arranged to define a nip with a core in said winding position, said application unit being designed so that a fold develops in the leading end of the upstream segment of the material and enters said nip when said application unit is in said advanced position.

12. The apparatus of claim 7, wherein said wrapping element and said drawing roll have respective axes and said axes are substantially parallel to one another.

13. The apparatus of claim 7, wherein said drawing roll at said predetermined location is arranged to define a nip with a core in said winding position and said receiving element is directed towards said nip when said application unit is in said advanced position.

14. The apparatus of claim 13, wherein said receiving element is downwardly inclined towards said nip in said advanced position.

15. The apparatus of claim 1, further comprising a pivotable support; and wherein said application unit comprises a carrier pivotally mounted on said support, said wrapping element being mounted on said carrier.

16. The apparatus of claim 15, wherein said support has a free end portion and said carrier is mounted on said free end portion.

17. The apparatus of claim 15, wherein said application unit comprises a pivotable holding element for said receiving element; and further comprising means for moving said application unit between said retracted position and said advanced position, said moving means being coupled to said holding element.

18. The apparatus of claim 17, wherein said application unit comprises a pivot which engages said holding element at one location thereof and said moving means engages said holding element at another location of the latter which is spaced from said one location.

19. The apparatus of claim 17, wherein said application unit further comprises means for limiting pivotal movement of said holding element.

20. The apparatus of claim 17, wherein said conveying means comprises a drawing roll, said wrapping element and said drawing roll having respective axes, and said holding element being pivotable about a pivot axis which is substantially parallel to said respective axes.

21. A winding apparatus, comprising means for conveying a length of material along a predetermined path; means for winding the material; means for dividing the material into a downstream segment and an upstream segment having a leading end; means for supplying a core which is to be wound with the material to a winding position in which the core is positioned to initiate winding of the upstream segment of the material onto the core; and means for initiating winding of the upstream segment of the material onto a core in said winding position, said initiating means including an application unit provided with a wrapping element of predetermined diameter, and a plate receiving element extending around part of the circumference and across substantially the entire length of said wrapping element, said application unit being movable between a retracted position and an advanced position in which said wrapping element cooperates with a core in said winding position to wrap the material around a part of the periphery of the core having an angular measure of at least 240 degrees, and said receiving element having a leading edge as considered in the direction of movement of said application unit from said retracted position to said advanced position and a generally convex external surface which faces away from said wrapping element, said receiving element being arranged such that the upstream segment of the material is receivable on said surface, and said conveying means including a drawing roll which is disposed at a predetermined location in the region of said winding position and spaced from said winding means when winding of a core is initiated, said leading edge extending transverse to said direction and being spaced from said drawing roll and from the periphery of a core in said winding position by a distance of about 0.3 to about 2 times said predetermined diameter when said application unit is in said advanced position and said drawing roll is at said predetermined location, and said drawing roll at said predetermined location being arranged to be in driving engagement with a core in said winding position, to rotate a core in said winding position in a predetermined sense and to define a nip with a core in said winding position, said application unit traveling in said predetermined sense during movement from said retracted position to said advanced position, and said retracted and advanced positions being arranged so that said wrapping element entrains the material and at least partially wraps the same around a core in said winding position during movement of said application unit from said retracted position to said advanced position, said application unit being designed so that a fold develops in the leading end of the upstream segment of the material and enters said nip when said application unit is in said advanced position, and said wrapping element and said drawing roll having respective axes which are substantially parallel to one another and to said leading edge.

22. A winding apparatus, comprising means for conveying a length of material along a predetermined path; means for winding the material; means for dividing the material into upstream and downstream segments; means for supplying a core which is to be wound with the material to a winding position in which the core is positioned to initiate winding of the upstream segment of the material onto the core; and means for initiating winding of the upstream segment of the material onto a core in said winding position, said initiating means including an application unit provided with a wrapping element, and a receiving element extending around part of the circumference of said wrapping element, said application unit being movable between a retracted position and an advanced position in which said wrapping element cooperates with a core in said winding position to wrap the material around part of the periphery of the core, and said receiving element having a surface which faces away from said wrapping element, said receiving element being arranged such that the upstream segment of the material is receivable on said surface, and said conveying means comprising a drawing roll which is disposed at a predetermined location in the region of said winding position when winding of a core is initiated, said drawing roll at said predetermined location being arranged to be in driving engagement with a core in said winding position and to rotate a core in said winding position in a predetermined sense, and said application unit traveling in said predetermined sense during movement from said retracted position to said advanced position, said retracted and advanced positions being arranged so that said wrapping element entrains the material and at least partially wraps the same around a core in said winding position during movement of said application unit from said retracted position to said advanced position.

23. The apparatus of claim 22, wherein said conveying means comprises a drawing roll which is disposed at a predetermined location in the region of said winding position when winding of a core is initiated, said guide and said drawing roll being fixed relative to one another.

24. The apparatus of claim 23, further comprising a pivotable support having a free end portion, said guide being mounted on said support in the region of said free end portion, and said drawing roll also being mounted on said support.

25. The apparatus of claim 24, wherein said supplying means comprises a core holder; and further comprising means pivotally mounting said holder on said support for movement between a first position in which said holder receives a core and a second position in which said holder locates a core in said winding position.

26. The apparatus of claim 25, wherein said drawing roll is disposed between said holder mounting means and said guide.

27. A winding apparatus, comprising means for conveying a length of material along a predetermined path; means for winding the material; means for dividing the material into upstream and downstream segments; means for supplying a core which is to be wound with the material to a winding position in which the core is positioned to initiate winding of the upstream segment of the material onto the core; means for initiating winding of the upstream segment of the material onto a core in said winding position, said initiating means including an application unit provided with a wrapping element, and a receiving element extending around part of the circumference of said wrapping element, said application unit being movable between a retracted position and an advanced position in which said wrapping element cooperates with a core in said winding position to wrap the material around part of the periphery of the core, and said receiving element having a surface which faces away from said wrapping element, said receiving element being arranged such that the upstream segment of the material is receivable on said surface; and a guide for said application unit, said guide including an arcuate portion having a first end in which said application unit is in said advanced position and a second end in which said application unit is in said retracted position, and said guide further including a straight portion which extends from said second end and has another end in which said application unit is in a rest position.

28. The apparatus of claim 27, wherein said arcuate portion has a curvature at least approximating that of a core.

29. A winding apparatus, comprising means for conveying a length of material along a predetermined path; means for winding the material; means for dividing the material into upstream and downstream segments; means for supplying a core which is to be wound with the material to a winding position in which the core is positioned to initiate winding of the upstream segment of the material onto the core; means for initiating winding of the upstream segment of the material onto a core in said winding position, said initiating means including an application unit provided with a wrapping element, and a receiving element extending around part of the circumference of said wrapping element, said application unit being movable between a retracted position and an advanced position in which said wrapping element cooperates with a core in said winding position to wrap the material around part of the periphery of the core, and said receiving element having a surface which faces away from said wrapping element, said receiving element being arranged such that the upstream segment of the material is receivable on said surface; and a guide for said application unit, said guide including an arcuate portion having a first end in which said application unit is in said advanced position and a second end in which said application unit is in said retracted position.

30. The apparatus of claim 29, wherein said arcuate portion has a curvature at least approximating that of a core.

31. The apparatus of claim 29, further comprising a pivotable support having a free end portion, said guide being mounted on said support in the region of said free end portion.

32. The apparatus of claim 29, wherein said application unit comprises a guide element in engagement with said guide, and a carrier pivotally mounted on said guide element, said wrapping element and said receiving element being mounted on said carrier.

33. The apparatus of claim 32, wherein said application unit further comprises means for limiting pivotal movement of said carrier.

34. The apparatus of claim 32, wherein said conveying means comprises a drawing roll, said wrapping element and said drawing roll having respective axes, and said carrier being pivotable on a pivot axis which is substantially parallel to said axes respective.

35. The apparatus of claim 32, wherein said carrier has a free end portion, said wrapping element and said receiving element being mounted on said free end portion.

36. The apparatus of claim 32, wherein said application unit further comprises means for biasing said wrapping element towards a core in said winding position.

37. The apparatus of claim 36, wherein said biasing means comprises a tension spring which is connected to said guide element and to said carrier.

38. A winding apparatus, comprising means for conveying a length of material along a predetermined path; means for winding the material; means for dividing the material into upstream and downstream segments; means for supplying a core which is to be wound with the material to a winding position in which the core is positioned to initiate winding of the upstream segment of the material onto the core; a pivotable support; and means for initiating winding of the upstream segment of the material onto a core in said winding position, said initiating means including an application unit provided with a wrapping element, and a receiving element extending around part of the circumference of said wrapping element, said application unit being movable between a retracted position and an advanced position in which said wrapping element cooperates with a core in said winding position to wrap the material around part of the periphery of the core, and said receiving element having a surface which faces away from said wrapping element, said receiving element being arranged such that the upstream segment of the material is receivable on said surface, and said application unit further comprising a carrier pivotally mounted on said support, said carrier including a two-armed lever having a leading and a trailing free end portion as considered in the direction of travel of said application unit from said retracted position to said advanced position, and said wrapping element being mounted on said leading free end portion, said application unit additionally comprising a guide roll which is mounted on said trailing free end portion.

39. The apparatus of claim 38, wherein said conveying means comprises a drawing roll, said drawing roll, wrapping element and guide roll having respective axes which are substantially parallel to one another, and said carrier being pivotable on a pivot axis which is substantially parallel to said respective axes.

40. A winding apparatus, comprising means for conveying a length of material along a predetermined path; means for winding the material; means for dividing the material into upstream and downstream segments; means for supplying a core which is to be wound with the material to a winding position in which the core is positioned to initiate winding of the upstream segment of the material onto the core; a pivotable support; means for initiating winding of the upstream segment of the material onto a core in said winding position, said initiating means including an application unit provided with a wrapping element, and a receiving element extending around part of the circumference of said wrapping element, said application unit being movable between a retracted position and an advanced position in which said wrapping element cooperates with a core in said winding position to wrap the material around part of the periphery of the core, and said receiving element having a surface which faces away from said wrapping element, said receiving element being arranged such that the upstream segment of the material is receivable on said surface, and said application unit further comprising a carrier pivotally mounted on said support and a pivotable holding element for said receiving element, said wrapping element being mounted on said carrier; and means for moving said application unit between said retracted position and said advanced position, said moving means being coupled to said holding element and including a pneumatic or hydraulic cylinder.

* * * * *